United States Patent [19]

Wittner

[11] 4,058,691

[45] Nov. 15, 1977

[54] ADAPTOR MOUNTING FOR ADJUSTABLE DISTRIBUTOR CONTACT BREAKER ASSEMBLY MODULE

[75] Inventor: Milton Wittner, Elmont, N.Y.

[73] Assignee: Vonsimi Sales Corporation, Great Neck, N.Y.

[21] Appl. No.: 711,747

[22] Filed: Aug. 4, 1976

[51] Int. Cl.[2] ..... H01H 19/62; F02P 7/00; H01H 9/08

[52] U.S. Cl. ..... 200/31 R; 123/146.5 A; 200/31 A; 200/31 DP

[58] Field of Search ..... 200/19 R, 19 A, 19 DC, 200/19 DR, 31 R, 31 A, 31 CA, 31 DP, 31 V; 123/146.5 A

[56] References Cited

U.S. PATENT DOCUMENTS

| | | | |
|---|---|---|---|
| 1,786,814 | 12/1930 | Arbuckle | 240/44.2 |
| 1,869,814 | 8/1932 | Karkau | 200/31 CA |
| 3,096,405 | 2/1963 | Bettoni | 200/31 A |
| 3,207,864 | 9/1965 | Bettoni et al. | 200/31 DP X |
| 3,646,301 | 2/1972 | Huntzinger et al. | 200/19 R X |
| 3,769,471 | 10/1973 | Beard | 200/31 DP |
| 3,795,778 | 3/1974 | Rees | 200/19 R |
| 3,833,777 | 9/1974 | Clark | 200/31 DP X |
| 3,862,384 | 1/1975 | Hrabovsky | 200/19 R |
| 3,956,602 | 5/1976 | Clark | 200/31 A |
| 4,011,851 | 3/1977 | Beutler | 200/30 A |

FOREIGN PATENT DOCUMENTS

| | | |
|---|---|---|
| 563,267 | 11/1932 | Germany |
| 1,142,078 | 1/1963 | Germany |

*Primary Examiner*—James R. Scott
*Attorney, Agent, or Firm*—Morgan, Finnegan, Pine, Foley & Lee

[57] ABSTRACT

A tune up device for a distributor of an internal combustion engine having an adaptor adjustably mounted on the distributor adjacent to the distributor cam, and a replaceable module having contact points positioned on the distributor, wherein once the adaptor is positioned, it provides the proper setting for the contact point gap or dwell angle. When the adaptor has been installed the gap between the contact points and dwell angle remains the same from the initial module to each replaceable module. Further settings are not necessary. Each time the tune up is desired the module is removed and simply replaced.

11 Claims, 12 Drawing Figures

ADAPTOR MOUNTING FOR ADJUSTABLE DISTRIBUTOR CONTACT BREAKER ASSEMBLY MODULE

FIELD OF INVENTION

This invention relates to a tune up device for a distributor for an internal combustion engine.

BACKGROUND OF THE INVENTION

The distributor for an internal combustion sequentially distributes high tension voltage to spark plugs for igniting the air-fuel mixture in combustion chambers under optimum compression conditions. The efficiency of the engine and the quality of the exhaust requires that the distributor provide the spark producing voltage in each combustion chamber at the correct time. Improper timing will cause, among other things, significant decrease in engine efficiency and a corresponding increase in exhaust pollutants.

To provide the spark producing voltage at the proper time, the distributor includes a cam, a movable arm with a rubbing block or cam follower, and a pair of contact points. One of the points is secured to the movable arm and the points are normally urged closed by a spring connected to the arm.

The cam is rotated by the engine through gears, and includes a number of lobes with high points which correspond to the number of combustion chambers. As the cam is rotated the lobes sequentially are positioned adjacent the cam follower. For a predetermined number of degrees of rotation of each lobe, the points remain closed because the cam follower is not in contact with the high point on the adjacent lobe. When the points are closed, current at a relatively low voltage from the ignition system passes through the points. During this time spark producing voltage is not provided to the spark plugs.

As each lobe continues to rotate its high point moves toward and comes into contact with the cam follower. At this time the cam opens the contact points. The desired distance between opened contact points always is reached at the high point of each cam lobe. When the points are opened a high tension voltage is introduced in the system which passes through the distributor to a designated spark plug for igniting the airfuel mixture in the combustion chamber.

The number of degrees of rotation of the cam during which the points are closed is called cam or dwell angle. The optimum distance between the points effected by a cam lobe is called the contact point gap or setting. This setting, generally determined by the manufacturer of the engine, contributes to the amount and time of the spark inducing voltage at a plug which the manufacturer believes is necessary for proper running of the engine.

The contact point gap or dwell angle must be set accurately. If the dwell time is too short a weak spark will result at the plug. If the dwell time is too great, the contact points will not open long enough resulting in a loss of timing and misfiring in the combustion chamber.

Moreover, as the points are opened a condensor or capacitor electrically connected to the movable point provides a place for current to flow while the contact points are open. Without a condensor, or with a defective one, arcing will occur which will seriously limit the useful life of the points.

To meet exacting conditions, and because of mechanical and electrical wear, the contact points and to a more limited extent, the condensor and related equipment should be replaced periodically.

Prior to the present invention, each change of distributor components, particularly the points and condensor, has been relatively complex and expensive. Each time special tools and equipment must be used to provide an accurate gap setting and dwell angle. Frequently, each component each time also requires separate disconnection and removal, and subsequent replacement and electrical connection. Due to complexities, the maintaining and service procedures are time consuming and more often are done by a mechanic who must have expertise. Also the service costs are meaningful and the services provided at the inconvenience of the vehicle owner.

Moreover, prior to the present invention, the spring means connected to the arm which normally urged the points closed, only applied pressure and did not provide point alignment. As a result the points commonly were misaligned causing inefficient electrical transfer between the points and excessive wear.

Thus, prior to the present invention, contact point and condensor devices and systems have been beset by a number of significant drawbacks.

SUMMARY OF THE INVENTION

It is a primary object of the present invention to provide a tune up device which overcomes the drawbacks of existing devices and systems.

Another object of the present invention is to provide such a tune up device which readily can be installed, maintained, removed and replaced by most anyone.

It is another object of the present invention to have a tune up device having contact points where the gap setting and dwell angle are set for the initial pair of installed points and thereafter the replacement points automatically have that setting.

It is still another object of the present invention to provide a tune up device with preset points where only the initial pair need be adjustably positioned on the distributor, and where after that replacement of the preset points automatically will be properly positioned on the distributor.

It is a further object of the present invention to have a tune up device including an adaptor and a replaceable module with contact points and other wearing parts, wherein once the adaptor is positioned on the distributor upon initial installation, the module can be replaced as parts wear without having to reset the contact point gap and timing.

It is a further object of the present invention to provide a tune up device which maintains the points in proper alignment.

Additional objects and advantages will be set forth in part hereinafter and in part will be obvious herefrom or may be learned with the practice of the invention, the same being realized and obtained by means of the modular unit recited in the appended claims.

In accordance with the present invention there is provided a tune up device for a distributor of an internal combustion engine having an adaptor adapted to be adjustably mounted on the distributor adjacent to the distributor cam, and a replaceable module having contact points adapted to be positioned on the distributor, wherein once the adaptor is positioned, it provides the proper setting for the contact point gap and dwell angle. Once the adaptor has been installed the gap between the contact points and dwell angle remains the same from replaceable module to replaceable module. Further settings are not necessary. Each time a tune up is desired the module is removed and simply replaced. Preferably the module includes components which wear before the normal life of the distributor. Included on the module are the condensor, insulator bushing, the cam follower, and the spring means which normally urge the points closed.

With this tune up device the adjustment or setting is done once. Thereafter the adaptor retains the proper setting from module to module.

The adaptor and module include locating means which engage one another. The relationship of their position relative to one another is always the same. When the locating means are positioned on the distributor a fixed distance from the center line of the cam, the contact points will be opened to the desired gap by the cam and remain closed for the proper dwell angle. The positioning of the adaptor locating means is done once. After that the adaptor retains the proper setting and the modules can be replaced as desired without further adjustment.

To position the adaptor on the distributor upon initial installation, the device includes means for contacting the cam. When the means is in contact with a high point on the cam, the adaptor locating means is positioned the desired fixed distance from the center line of the cam. This fixed distance has been predetermined so that engagement by the module and adaptor locating means automatically provides the desired setting for the contact points.

The positioning means of the invention can be on the adaptor, module, or both, or it can be a separate component of the device. In one of the embodiments, the positioning means is an interference means in the form of a projection or tab which extends inwardly from the device for contact with the cam when the device is placed on the distributor. In another embodiment of the invention the positioning means is a guide which positively engages the cam for positioning the adaptor on the distributor.

The contact points are preset but can be adjusted by the user upon initial installation of the device or any time thereafter. Whether the contact points are preset or adjusted, the installed adaptor retains the proper contact point setting. Replacement of the module can be made as desired. Each time the module is replaced by a duplicate module, the contact points will assume the previous setting without additional adjustments. Generally the adjustment is done once for the normal life of the distributor and car.

BRIEF DESCRIPTION OF THE DRAWINGS

The following is a detailed description together with accompanying drawings of the invention. It is to be understood that the invention is capable of modification and variation apparent to those skilled in the art within the spirit and scope of the invention.

In the Drawings:

Referring to FIG. 1 there is shown a distributor 10 including a tune up device 12 of the invention.

Figure 1:
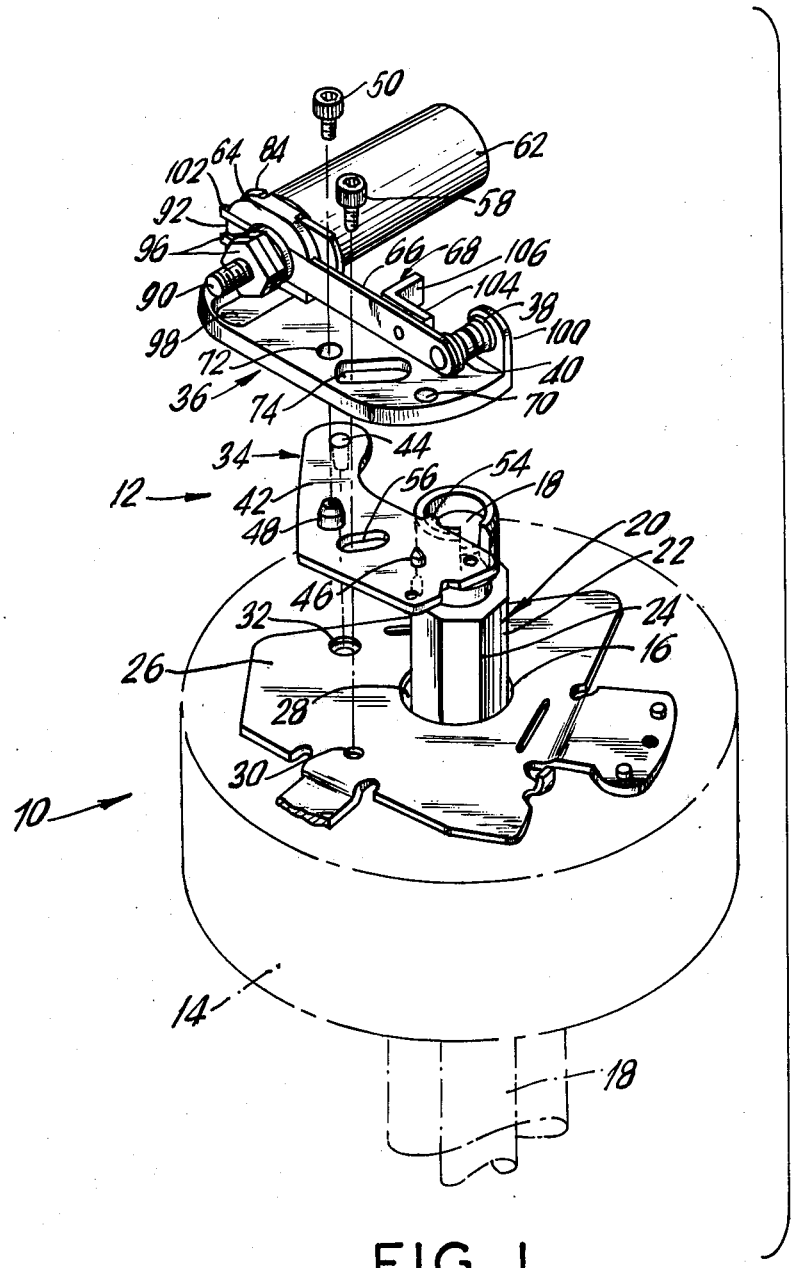
FIG. 1 is an exploded perspective view of the distributor showing the tune up device of the invention including an adaptor for mounting on the distributor and a replaceable module suspended above the adaptor.

The distributor 10 has a housing 14 with a central opening 16 through which a rotatable shaft 18 extends. The shaft 18 carries a cam 20 and both are rotated through gears driven by the internal combustion engine itself (not shown). In the illustrated embodiment the cam 20 has eight lobes 22 with eight high points 24 which correspond to the number of the cylinders of the engine.

On the distributor housing 14 is mounted a breaker plate 26 which has a central opening 28 for the shaft 18 and cam 20. Extending through the plate 26 are positioning means, such as spaced points 30 and 32, for adjustably positioning the tune up device 12 on the distributor 10 in relationship to the cam 20. As shown in FIG. 1 the point 30 is a threaded hole and point 32 is a recessed hole.

The tune up device 12 has an adaptor 34 which is pivotally mounted on the distributor breaker plate 26 adjacent to the cam 20, and a replaceable module 36 mounted on the adaptor 34 which includes a pair of preset contact points 38 and 40. Once the adaptor 34 is positioned on the plate 26 it provides the proper setting for the contact point gap and dwell angle. This setting remains the same from replaceable module 36 to replaceable module 36. Each time a tune up is desired the module 36 is removed and simply replaced by a duplicate module 36. Further adjustment is not needed.

Figure 4:
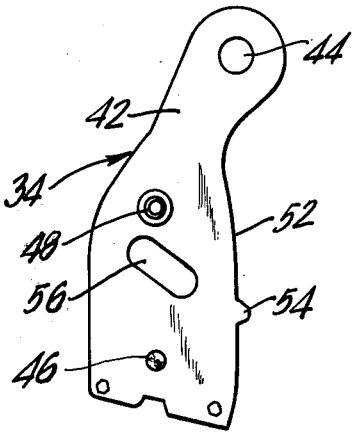
FIG. 4 is a plan view of an adaptor of the invention.
Figure 5:
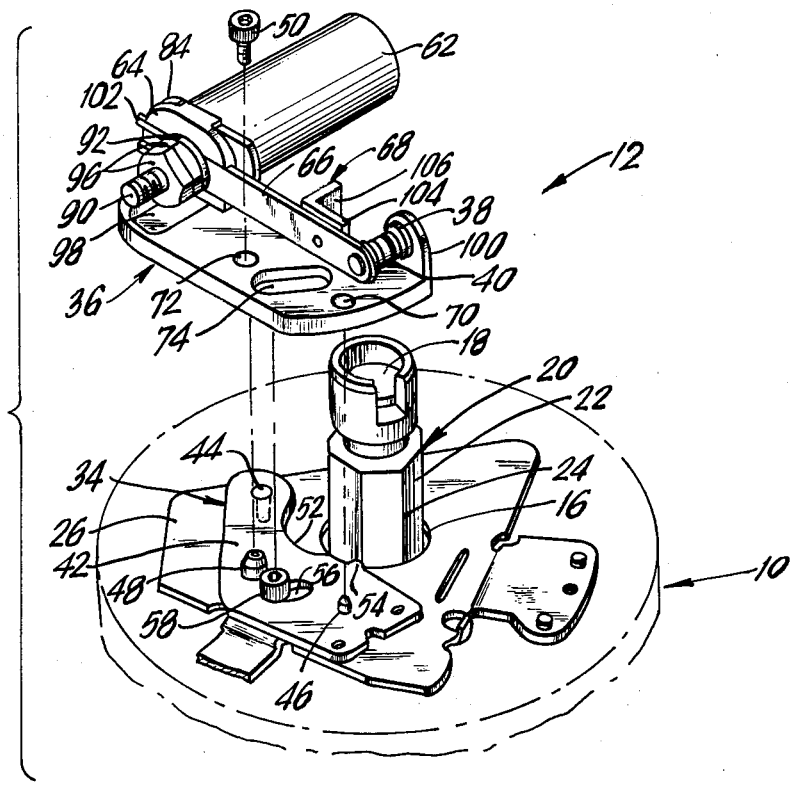
FIG. 5 is a perspective view of the tune up device of the invention showing the adaptor secured to the distributor ready to receive the replaceable module.
Figure 6:
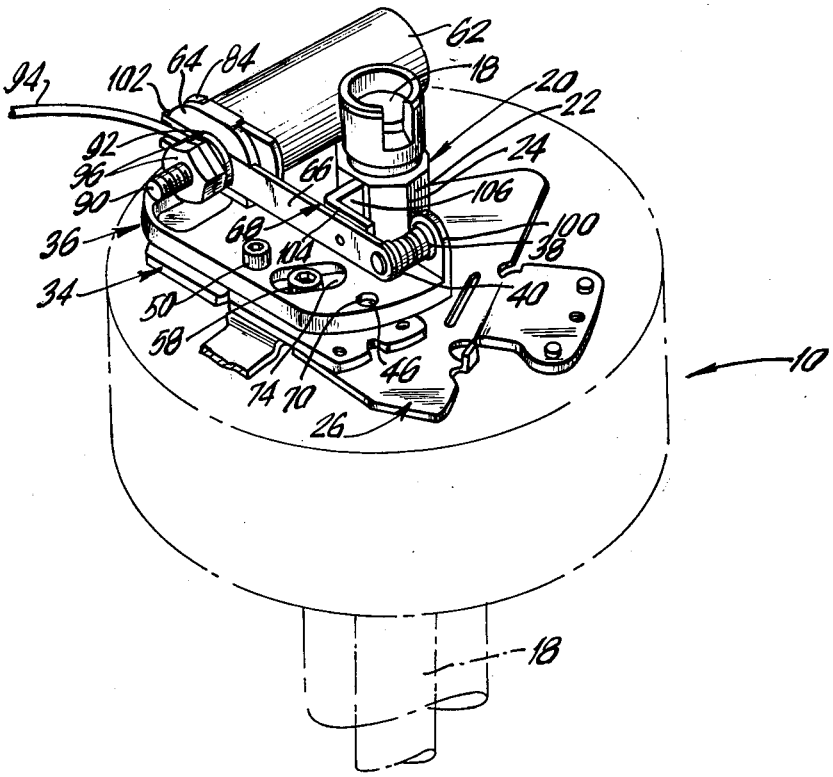
FIG. 6 is a perspective view of the assembled tune up device of the invention on the distributor.

As shown the embodiment of the invention shown in FIGS. 1 and 4 the adaptor 34 is a curved metal plate 42. Depending from the curved end of the adaptor plate 42 is a pin 44 which projects into the recessed hole 32 for pivotally mounting the adaptor 34 on the breaker plate 26. On the adaptor plate 42 are locating means, such as a pair of spaced upwardly extending points 46 and 48, for positioning the module 36. Point 46 is a pin, and point 48 is a threaded tube which receives a screw 50. Extending inwardly from the inner surface 52 of the essentially straight portion of the plate 42 is interference means, which in the illustrative embodiment is a positioning tab 54. With the tab 54 in contact with a high point 24 on the cam 20, the adaptor locating points 46 and 48 are spaced on either side of the cam 20 a fixed, predetermined distance from the center line of the shaft 18 and cam 20.

Once the locating points 46 and 48 are positioned on the distributor 10 the adaptor 34 retains this setting from module 36 to module 36. The positioning of the adaptor locating points 46 and 48 is done once upon initial installation. Thereafter, the adaptor 34 retains its setting.

To facilitate positioning of the adaptor 34 a slot 56 extends through the adaptor plate 42 intermediate points 46 and 48. When the adaptor 34 is pivotally mounted on the plate 42 the slot 56 is over and open to the threaded hole 30 of the distributor plate 26. Once the adaptor 34 is in position with the tab 54 in contact with a cam high point 24 the adaptor 34 is secured in place such as by a screw 58. The screw 58 extends through the slot 56 and is threaded into the hole 30 until the screw head is tight against the upper adaptor plate surface about slot 56.

Preferably, the adaptor 34 is pivotally mounted on the distributor plate 26 and the screw 58 is threaded partially into the hole 30. When the tab 54 is in contact with a cam high point the screw 58 is tightened. As shown in FIG. 1 the screw head can have a hexagonal recess for tightening by an allen wrench.

Figure 2:
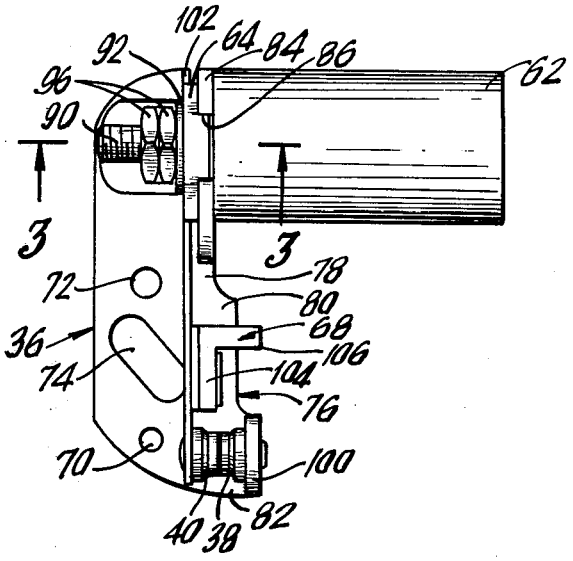
FIG. 2 is a plan view of the replaceable module.
Figure 3:
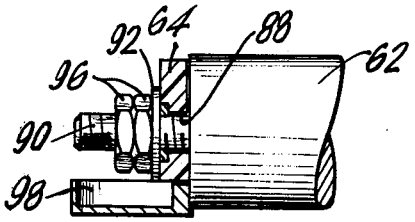
FIG. 3 is a cross-sectional view of FIG. 2 taken along the lines 3—3 of FIG. 2.

As shown in FIGS. 1–3 each replaceable module 36 contains the wearing parts of the device 12, including the preset pair of contact points 38 and 40, a condensor 62, an insulating bushing 64, a spring 66 which directly urges the points 38 and 40 closed, and an L-shaped cam follower or rubbing block 68 for opening the points 38 and 40.

Each module 36 also has the same locating means, such as two spaced points 70 and 72, which cooperate with points 46 and 48 to properly position the module 36 on the distributor 10. The relationship of the adaptor and module locating means relative to one another is always the same. When the adaptor locating points 46 and 48 are positioned the predetermined fixed distance from the center line of the shaft 18 and cam 20, engagement between adaptor points 46 and 48 and module points 70 and 72 automatically properly positions the module 36 on the distributor 10. This fixed distance has been predetermined so that engagement by the module and adaptor locating points 46 and 48 and 70 and 72 automatically provides the desired setting for the contact points 38 and 40. Once set the contact points 38 and 40 will be opened to the desired gap by the cam high points 28 and remain closed for the proper dwell angle. With the initial adaptor setting on the distributor 10, the module 36 can be replaced as desired or needed without further adjustment.

In this embodiment module points 70 and 72 are holes which slidably fit over the adaptor pin 46 and tube 48. To accommodate the adaptor screw 58, a slot 74 extends through the module 36 between the holes 70 and 72. In position the slot 74 lies over the adaptor slot 56 and about the screw 58.

As shown in FIGS. 1–3, the module 36 has an inner surface 76 with three steps 78, 80 and 82.

Step 78 is the outermost step and is at one end of the module 36. Extending upwardly from step 78 is a generally U-shaped support 84 defining an open slot 86. Slidably mounted on the support 84 is the insulating bushing 64 which has a bore 88 extending therethrough with the slot 86. Abutting and extending outwardly from support 84 is the condensor 62. The condensor 62 has a threaded shaft 90 which slidably extends through the bushing bore 88. Slidably positioned on the shaft 88 over the module is a washer 92 and threaded onto the shaft 88 are a pair of lock nuts 96. The inner lock nut 96 is threaded onto the projecting shaft 90 to secure the condensor, bushing and washer assembly to the support 84. Between the nuts 96 there is connected to the shaft 88 electrical wiring 94 which also is connected to the primary coil of the ignition coil (not shown). To facilitate tightening and loosening the nuts 96, the portion of the module 36 beneath the shaft 90 has recess 98 therein.

Step 82 is the innermost step and is at the other end of the module 36. Extending upwardly from the step 82 is a fixed arm 100. Secured to the inner surface of the arm 100 is the fixed contact point 38.

The spring 66 is a leaf spring which extends across and above the module 36 from support 84 to and opposite the arm 100. Secured to the inner surface of the arm end of the spring 66 is the contact point 40. The point 40 is movable with the spring 66 which normally urges the points 38 and 40 closed.

The other or condensor end of the spring 66 has a yoke 102 between which the condensor shaft 90 extends. The spring 66 is anchored at this end by positioning the yoke 102 between the inner washer 92 and bushing 64 and tightening the lock nut 96.

As illustrated the spring 66 directly applies the pressure to the points 38 and 40 to normally urge them closed and maintains them in alignment. This dual function of the spring 66 provides efficient electrical transfer between the points 38 and 40 and inhibits excessive pitting.

Intermediate the spring ends and extending inwardly is the L-shaped cam follower or rubbing block 68. The block base 104 is secured to the spring 66 and its arm 106 extends inwardly for contacting the high point 26 of the cam 20. When module 36 is installed on the adaptor 34 the block 68 lies directly over the interference tab 54.

As will presently be explained, when a module 36 is positioned on the adaptor 34, the module 36 is secured to the adaptor 34. In the illustrative embodiment the screw 50 is placed through hole 70 and threaded into the tube 46. To tighten the screw 50, its head has a hexagonal recess for an allen wrench.

In practice of the invention the adaptor 34 is pivotally positioned on the distributor 10 upon initial installation of the device 12. The depending adaptor pin 44 is placed in engagement with the recessed hole 32 in the distributor plate 26, and the adaptor 34 pivotally is moved toward the cam 20 until the projecting tab 54 is in contact with the cam 20. Preferably the screw 58 is inserted through the slot 56 and threaded into the hole 30 until the adaptor 34 slidably drops on the distributor plate 26. Conveniently this can be achieved by tightening the screw 58 and then loosening it slightly, e.g., one quarter turn. Next the ignition is clicked to rotate the cam 20, e.g., 180°. In so doing the cam 20 will move the adaptor 34 back against the drag force until there is zero interference between the tab 54 and a cam high point 24. At zero interference the tab 54 is tangent to a cam high point 24. There is no or zero angle between the point 28 and tab 54. The distance the contacting tab point is from the center of the cam 20 is equal to the radius of the cam 20.

Thus, the adaptor 34 is pushed into contact with the cam 20 and the clicking of the ignition causes the cam to move the adaptor 34 back into proper position with zero interference between the contacting tab 54 and a cam high point 24. In this position the adaptor locating points 46 and 48 are the desired fixed distance from the center line of the cam 20. As stated previously this distance has been determined so that engagement by the module and adaptor locating points 46 and 48 and 70 and 72 automatically provides the desired setting for the contact points 38 and 40. With the tab 54 and the cam high point 24 in such contact the screw 58 is tightened to secure the positioned adaptor 34 to the distributor 10.

The positioning of the adaptor locating points 46 and 48 is done once upon initial installation. After that the adaptor 34 retains this setting ready to receive the replaceable modules 36 as desired without further adjustment.

Each module 36 with the present joints 38 and 40 is positioned on the distributor 10 by sliding module locating holes 70 and 72 over the adaptor locating pin 46 and tube 48.

With the tab 54 in contact with a cam high point 24 and the module and adaptor locating means in engagement 46 and 48 and 70 and 72, the contact points 38 and 40 will be opened to the preset gap by the cam 20 and remain closed for the proper dwell angle. The replaceable module 36 is secured in place by inserting the screw 50 through the hole 70 and threading into the adaptor tube 48.

In normal engine operation as the cam 20 is rotated the lobes 22 and high points 24 sequentially are positioned adjacent the rubbing block 68. For a predetermined number of degrees of rotation of each lobe 22, the contact points 38 and 40 remain closed because the block 68 is not in contact with a cam high point 24. During this time the spark producing voltage is not provided at the spark plugs.

As the cam 20 continues to be rotated a cam high point 24 moves towards and comes into contact with the block 68. At this time the cam 20 opens the contact points 38 and 40 to the preset gap. This causes high tension voltage to be provided at the spark plug which corresponds to the particular cam high point 24 and the air-fuel mixture is ignited in the appropriate combustion chamber.

As desired the module 36 is replaced by simply loosening screw 50 and outer lock nut 96 and removing the module 36 from the plate 26 and wire 94. The new replaceable module 36 with the new preset points 38 and 40 is placed on the adaptor 34 through engagement between the walls of the module locating holes 70 and 72 and the adaptor pin 46 and tube 48, the screw 50 is again tightened, and the wire 94 is connected to the condensor shaft 88 between the lock nuts 96. Further adjustment of the adaptor 34 is not needed. Each time the module 36 is replaced by a duplicate module 36 the contact points 38 and 40 will automatically be opened to the desired gap at the proper time.

In the illustrative embodiment the points 38 and 40 are preset to be opened to the desired gap or setting. This setting, generally is specified by the manufacturer to provide what it believes is the proper spark inducing voltage and the proper timing for such voltage. These points 38 and 40, however, can be adjusted by the user upon installation of the device 12 or at any time thereafter.

The adjustment can be accomplished by removing the tab 54 and positioning the adaptor 34 and module 36 on the distributor 10. The adaptor 34 and module 36 are moved toward the cam 20 until the block 68 is in contact with a cam high point 24. With conventional gauges between the points 38 and 40, the adaptor 34 and module 36 are adjusted until the desired gap setting is achieved. Once this is done the screws 50 and 58 are tightened, and the device 12 is ready for operation. In this instance each cam high point 24 will open the points 38 and 40 to the adjusted gap setting.

Whether the contact points 38 and 40 are preset or adjusted, however, the installed adaptor 34 retains the desired contact point setting. Replacement of the module 36 is made as desired. Each time the module 36 is replaced, the contact points 38 and 40 will assume the previous setting without additional adjustment because each module 36 is a duplicate or is the same as the previous module 36.

In the illustrated embodiment the interference means, tab 54, is on the adaptor 34. This tab 54 also can be on the module 36 alone or on both the adaptor 34 and module 36. When the tab 54 is on the module 36 alone, initial installation of the adaptor 34 is accomplished by engaging the locating points 46 and 48 and 70 and 72 and positioning the adaptor 34 and module 36 on the distributor 10 as a unit. Here again, once the adaptor 34 is positioned on the distributor 10 further adjustment is not necessary. Each time the module is replaced by a duplicate module the contact points 38 and 40 will assume the previous setting without additional adaptor adjustment. Generally the adaptor adjustment is done once for the normal life of the distributor and car.

Moreover, the tab 54 can be of a wide variety of configurations, each of which projects inwardly from the device 12 toward the cam 20.

The locating means on the adaptor 34 and module 36 also can be varied as long as they engage one another and prevent relative rotation therebetween. For example, the module locating means can be a depending geometric figure, e.g., a diamond, semi-circle, etc., which slidably fits into a corresponding locating recess in the adaptor.

Referring now to FIGS. 7–12, additional embodiments of the invention are illustrated. Where convenient the same reference numbers used in describing the embodiment of the invention shown in FIGS. 1–6 will be used.

Figure 7:
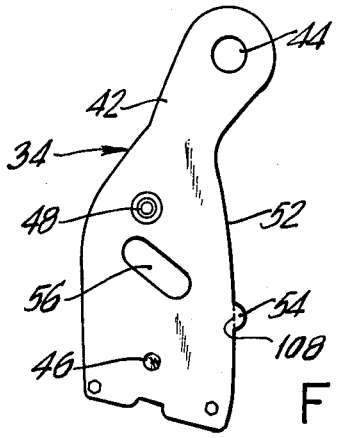
FIG. 7 is a plan view of another embodiment of the adaptor of the invention in which the interference means is in the form of a removable tab.
Figure 8:
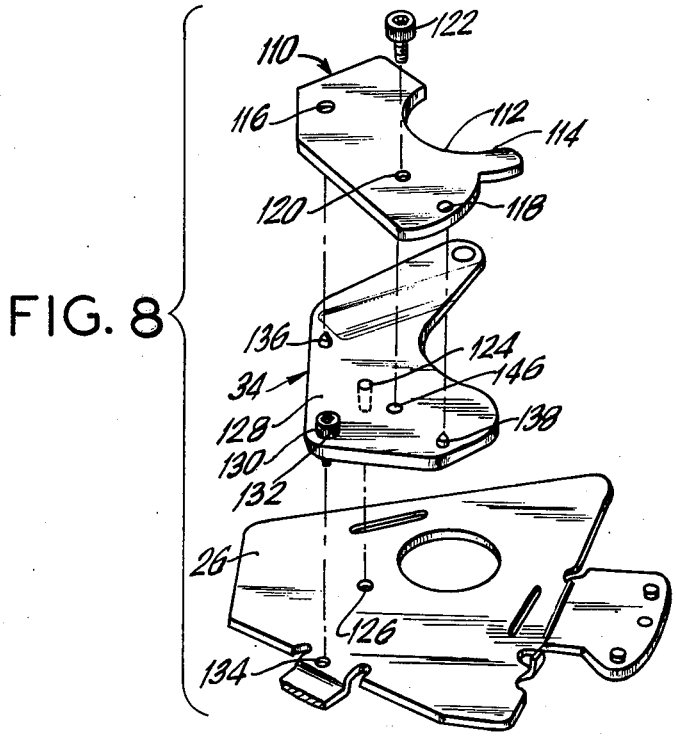
FIG. 8 is a further embodiment of the tune up device of the invention in an exploded perspective view illustrating an adaptor with interference means in the form of a removable positioning key.

Referring to FIG. 7 the adaptor 34 includes means to facilitate removal of the tab 54. In this embodiment the line 108 of connection between the positioning tab 54 and adaptor plate 42 is scored or weakened. Accordingly, when one desires to have a gap setting for the points other than the preset gap, the user simply removes the tab 54 by bending it along line 108.

The adaptor 34 shown in FIG. 7 can be used with breaker plates which move eccentrically about the center of the cam 20 for advancing the timing of the spark. In rotation the cam 20 readily will wipe off the tab 54. As in the earlier described embodiment of the invention once the adaptor 34 of FIG. 7 is set further adjustment is not needed. As desired, the module with the contact points is simply replaced and the points will assume the previous setting.

Referring to FIGS. 8–11 there is shown an embodiment of the invention which includes a separate positioning member 110.

Upon initial installation, the adaptor 34 is positioned on the distributor 10 by the member 110 which engages the cam 20 and adaptor 34. Once the adaptor 34 has been installed on the distributor 10 further settings are not necessary. The member 110 is removed and the adaptor 34 is ready to receive the replaceable modules 36. Each time a tune up is desired the module 36 is removed and replaced by a duplicate module 36 without any additional adjustment.

The member 110 is flat having an inner surface 112 which defines a central semi-circular guide 114 having the same radius as the radius of the cam 20. The guide 114 typically has a circumference of about 180° and is slidable about the cam lobes 22. The depth of the guide 114 is about one half the distance across the lobes 22 and the breadth is equal to the breadth of the lobes 22 so as to provide sliding engagement therewith.

Figure 9:
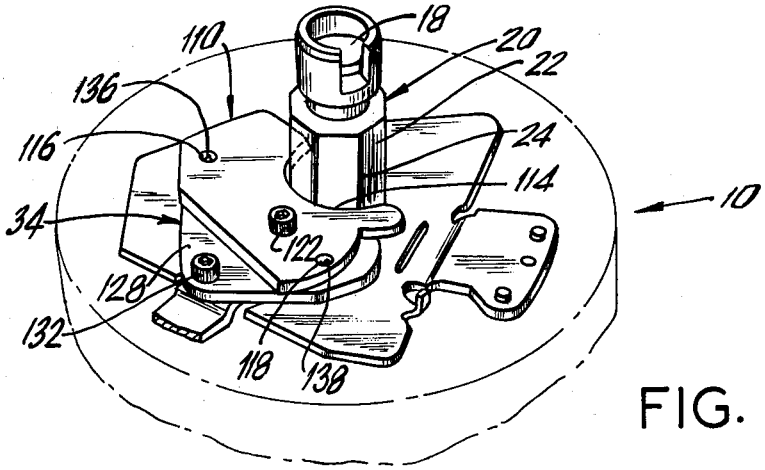
FIG. 9 is a perspective view of the embodiment of the invention shown in FIG. 8 showing the adaptor and positioning key mounted on the distributor.

In addition, the member 110 includes a pair of spaced positioning points 116 and 118. In this embodiment the points 116 and 118 are holes which extend through the member 110 and are positioned on either side of the cam lobes 22. When the key guide 114 is positioned about the lobes 22 as shown in FIG. 9, the points or holes 116 and 118 are always on either side of the cam 20 and the same distance away from the center line of the shaft 18. Between the holes 116 and 118 is a threaded hole 120 through which a screw 122 extends for securing the member 110 to the adaptor 34.

The adaptor 34 includes a centrally positioned depending pin 124 which extends into a hole 126 in the distributor plate 26 for pivotally mounting the adaptor 24 thereto. At the outer apex 128 of the adaptor 34 is a threaded hole 130 through which a screw 132 extends for threading into a threaded plate hole 134 to secure the positioned adaptor 34 to the plate 26.

The adaptor locating means in this embodiment is a pair of spaced pins 136 and 138 adapted to extend into the member holes 116 and 118. When the member 110 and adaptor 34 are assembled as shown in FIG. 9, the pins 136 and 138 also are always on either side of the cam 20 the same distance away from the center line of the shaft 18.

In this embodiment the module 36 has a pair of spaced holes 140 and 142 into which the adaptor pins 136 and 138 extend and an intermediate threaded hole 144. Once the member 110 is removed as shown in FIG. 10 the screw 122 extends into the adaptor hole 146 to secure the module 36 to the adaptor 34.

In practice of this embodiment of the invention, the member 110 is secured to the adaptor 34 upon initial installation of the device 12 by threading screw 122 into the adaptor hole 146. This assembly is placed on the distributor plate 26 with the adaptor pin 136 in the distributor plate hole 126. At the same time the guide 114 encircles and engages the cam lobes 26. By pivotally adjusting the assembled member 110 and adaptor 34 on the plate 26 the adaptor locating pins 136 and 138 are positioned a fixed predetermined distance from the center line of the cam 20 (see FIG. 9). When the adaptor 34 is so positioned the screw 132 is threaded through adaptor apex hole 130 and into the plate hole 134 to secure the adaptor 34 to the plate 26.

Figure 10:
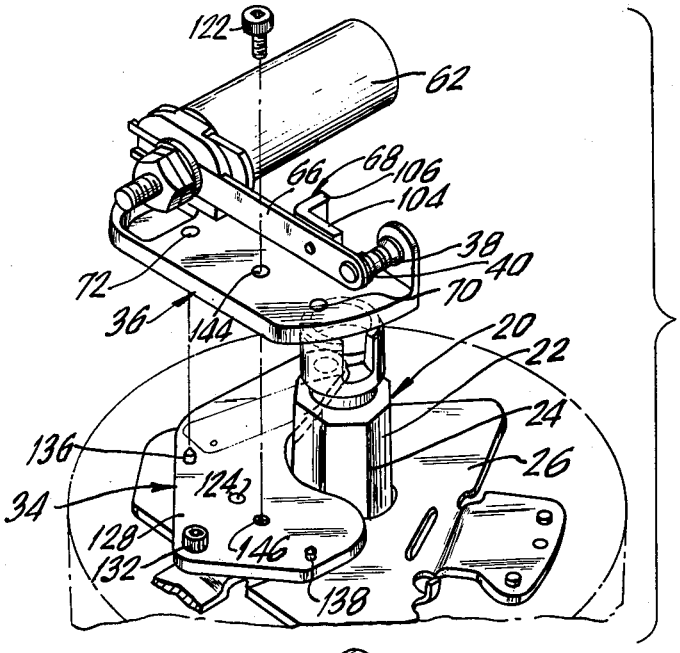
FIG. 10 is an exploded perspective view of the embodiment of the invention shown in FIG. 8 showing the adaptor secured to the distributor after removal of the key and the positioning of the replaceable module ready for connection to the adaptor.
Figure 11:
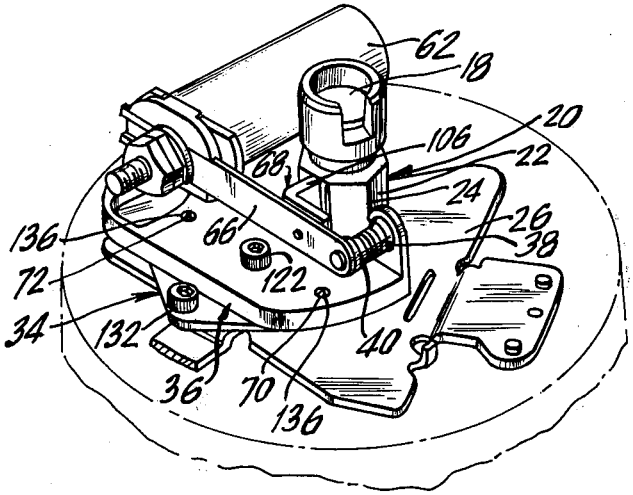
FIG. 11 is a perspective of the assembled tune up device of the invention.

With the adaptor 34 in position the member 110 is removed by loosening screw 122 and removing the member 110 (see FIG. 10). The adaptor 34 now is ready to receive the modules 36. As desired the modules 36 are positioned on the adaptor 34 by sliding the module locating holes 140 and 142 over the adaptor locating 136 and 138. When each module 36 has been positioned on the adaptor 34, the screw 122 is threaded into the adaptor hole 146 to secure the module 36 to the adaptor 34 (see FIG. 11). The rubbing block 68 is ready for engagement by the cam high points 28 for opening the contact points 38 and 40 to the desired gap.

With the guide 114 of the present invention, clicking of the ignition is not needed to position the adaptor 34. Rather the guide 114, which has the same radius as the cam 20, positively engages at least one cam high point 24. In so doing the adaptor 34 is properly positioned on the plate 26 with its locating means the predetermined distance from the center line of the cam 20.

Figure 12:
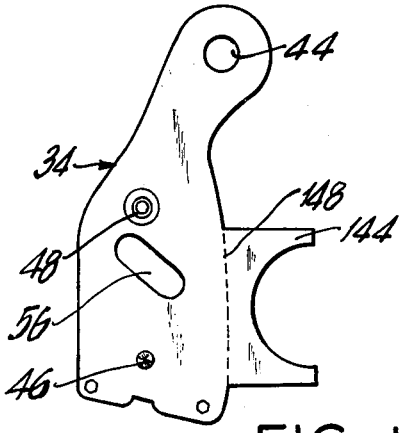
FIG. 12 is another embodiment of a removable interference means in the form of a hinged key.

Referring now to FIG. 12 there is shown another embodiment of the guide 114. In this embodiment the guide 114 is connected to the adaptor 34 along a line 148 while scored or weakened. Once the guide 114 properly positions the adaptor 34 on the plate 26, or when one desires to have a gap setting other than the present contact point gap, the user simply removes the guide 114 by bending it along the line 148.

In each of the described embodiments of the invention the positioning of the adaptor on the distributor is done once upon initial installation of the tune up device. After that the modules with the contact points can be replaced as desired. The old module is simply removed and replaced by a new duplicate module. Each time the module is replaced, the contact points will assume the previous setting. The high points of the rotating cam will open the contact points the predetermined distance at the right time. No further adjustment is needed.

The invention in its broader aspect is not limited to the specific described embodiments and departures may be made therefrom within the scope of the accompanying claims without departing from the principals of the invention and without sacrificing its chief advantages.

What is claimed:

1. A tune up device for a distributor of an internal combustion engine wherein the distributor has a cam for opening contact points to provide high tension voltage to each combustion chamber of the engine, comprising:

an adaptor adapted to be adjustably mounted on the distributor adjacent to the cam, and a replaceable module adapted to be positioned on the distributor adjacent the cam by said adaptor having a pair of preset normally closed contact points, a condensor and a cam follower adapted to be mounted on said adaptor, wherein once said adaptor is positioned on the distributor upon initial installation of said device said contact points will have the desired gap or dwell angle from module to module without further adjustment.

2. A tune up device for a distributor of an internal combustion engine wherein the distributor has a cam with high points for opening contact points to the desired gap for providing high tension voltage to each combustion chamber of the engine, comprising:

an adaptor to be adjustably mounted on the distributor adjacent to the cam, including locating means thereon adjusted to be positioned on the distributor a predetermined fixed distance from the center line of the cam for causing the high points of the cam to open the contact points to the desired gap, and a replaceable module adapted to be mounted on said adaptor having locating means thereon which engage said adaptor locating means and include normally closed contact points, and a cam follower adapted to sequentially contact each cam high point for opening the contact points to the desired gap, wherein the relationship of said locating means on said adaptor and module relative to one another is always the same so that when said locating means are positioned on the distributor a fixed predetermined distance from the center line of the cam, the contact points will be opened to the desired gap by the cam high points, and wherein once said adaptor is positioned on the distributor with its locating means the predetermined fixed distance from the center line of the cam upon initial installation, replacement of each module is achieved by engaging its locating means with said adaptor locating means, whereupon the contact points of each module automatically will assume the previous desired setting without additional adjustment.

3. The tune up device of claim 2, wherein said locating means on said adaptor and module in each instance is a pair of spaced points which engage one another and which when positioned on the distributor are on either side thereof the predetermined fixed distance.

4. The tune up device of claim 3, wherein said locating means are a pair of members which extend upwardly from said adaptor and a pair of holes in said module, the walls of which slidably engage said upstanding members.

5. A tune up device for a distributor of an internal combustion engine wherein the distributor has a cam for opening contact points to provide high tension voltage to each combustion chamber of the engine, comprising:

an adaptor adapted to be adjustably mounted on the distributor adjacent the cam, a replaceable module adapted to be positioned on said adaptor including a pair of preset normally closed contact points and a cam follower, and means for positioning said adaptor on the distributor upon initial installation of said device, wherein once said adaptor is positioned on the distributor upon initial installation said module can be replaced as required and each time said new module is positioned on the distributor said contact points have the desired gap or dwell angle from module to module without further adjustment.

6. A tune up device for a distributor of an internal combustion engine wherein the distributor has a cam with high points for opening contact points to provide high tension voltage to each combustion chamber of the engine, comprising:

an adaptor to be adjustably mounted on the distributor adjacent the cam including locating means thereon, a replaceable module having locating means thereon adapted to engage said adaptor locating means and including a pair of preset normal closed contact points, spring means normally urging said contact points closed, a condensor electrically connected to said contact points and a cam follower operatively connected to said spring means and adapted to be in contact with the cam high points when said module and adaptor locating means are engaged and said adaptor is positioned on the distributor, interference means extending inwardly from said device adapted to contact a high point on the cam when said adaptor is adjustably mounted on the distributor to position said adaptor locating means a fixed distance from the center line of the cam, wherein once said adaptor is so positioned on the distributor upon initial installation of said device said contact points have the desired gap or dwell angle from replaceable module to replaceable module without further adjustment.

7. A tune up device for a distributor of an internal combustion engine wherein the distributor has a cam with high points for opening contact points to the desired gap for providing high tension voltage to each combustion chamber of the engine, comprising:

an adaptor to be adjustably mounted on the distributor adjacent to the cam, including locating means thereon adjusted to be positioned on the distributor a predetermined fixed distance from the center line of the cam for causing the high points of the cam to open the contact points to the desired gap, a replaceable module adapted to be mounted on said adaptor having locating means thereon which engage said adaptor locating means and include normally closed contact points and a cam follower adapted to sequentially contact each cam high point for opening the contact points to the desired gap, the relationship of said locating means on said adaptor and module relative to one another is always the same so that when said locating means are positioned on the distributor a fixed predetermined distance from the center line of the cam, the contact points will be opened to the desired gap by the cam high points, and means operatively connected to said adaptor adapted to contact a high point on the cam when said adaptor is adjustably mounted on the distributor to position said adaptor locating means the fixed predetermined distance from the center line of the cam upon initial installation thereof, wherein once said adaptor is so positioned on the distributor replacement of each module is achieved by engaging its locating means with said adaptor locating means so that the contact points of each module automatically assume the previous desired setting without additional adjustment.

8. The tune up device of claim 7 wherein said means comprises a tab projecting inwardly from the adaptor for contacting a cam high point when said adaptor is adjustably mounted on the distributor adjacent the cam.

9. The tune up device of claim 7 wherein said means is removable for allowing the user of the device to adjust the gap setting of the contact points upon initial installation of said device.

10. The tune up device of claim 7 wherein said means is a separate component which engages the adaptor to position it on the distributor and is removable before mounting said module on said adaptor.

11. The tune up device of claim 10 in which said separate component includes a guide which is semicircular having a radius which is the same as the radius of the cam and which engages a cam high point for positioning said adaptor on the distributor.

* * * * *